US006867410B2

(12) United States Patent
Sasaki et al.

(10) Patent No.: US 6,867,410 B2
(45) Date of Patent: Mar. 15, 2005

(54) APPARATUS FOR MEASURING POSITION OF FINE PARTICLE

(75) Inventors: Keiji Sasaki, Hokkaido (JP); Junichi Hotta, Hokkaido (JP)

(73) Assignee: Japan Science and Technology Corporation, Saitama (JP)

( * ) Notice: Subject to any disclaimer, the term of this patent is extended or adjusted under 35 U.S.C. 154(b) by 280 days.

(21) Appl. No.: 10/239,221

(22) PCT Filed: Feb. 21, 2001

(86) PCT No.: PCT/JP01/01267

§ 371 (c)(1),
(2), (4) Date: Dec. 13, 2002

(87) PCT Pub. No.: WO01/71278

PCT Pub. Date: Sep. 27, 2001

(65) Prior Publication Data

US 2004/0011946 A1 Jan. 22, 2004

(30) Foreign Application Priority Data

Mar. 22, 2000 (JP) ..... 2000-081025

(51) Int. Cl.[7] ..... H01J 40/14
(52) U.S. Cl. ..... 250/222.2; 250/574
(58) Field of Search ..... 250/222.2, 574, 250/221, 573; 356/441, 442

(56) References Cited

U.S. PATENT DOCUMENTS 6,198,110 B1 * 3/2001 Kaye et al. ..... 250/575

FOREIGN PATENT DOCUMENTS

| | | |
|---|---|---|
| EP | 490697 | 6/1992 |
| JP | 8-262329 | 10/1996 |
| JP | 9-304266 | 11/1997 |

* cited by examiner

*Primary Examiner*—Que T. Le
(74) *Attorney, Agent, or Firm*—Wenderoth, Lind & Ponack, L.L.P.

(57) ABSTRACT

A device for measuring the three-dimensional position of a single particle (208) in a solution comprises a pulsed laser (201); a microscope system for irradiating a single particle with a laser beam (203) emitted from a pulsed laser (201); a photodetector (209) for detecting light dispersed by the single particle; a computer (211) for recording the signal detected by the photodetector (209) as displacement data and processing it; and a high-speed A/D board (210) for introducing the signal detected by photodetector (209) into the computer (211). Timing is set for data input so that the signal detected by the photodetector (209) may be input to the computer (211) at the moment of laser irradiation. It is possible to measure the position of a particle of nanometer size in real time with accuracy of nanometer order.

4 Claims, 4 Drawing Sheets

APPARATUS FOR MEASURING POSITION OF FINE PARTICLE

TECHNICAL FIELD

The invention of the present patent application relates to a fine-particle position measuring apparatus for measuring the three-dimensional position of a fine particle. More specifically, the invention relates to a fine-particle position measuring apparatus capable of implementing a real-time measurement of the position of a fine particle having a nanometer-order particle diameter with an accuracy of nanometer order and a measurement of microforces acting on the fine particle.

BACKGROUND ART

A fine particle (which hereinbelow will also be referred to as a "nanoparticle") having a nanometer-order particle diameter has properties that cannot be obtained from a bulk material in, for example, a quantum size effect and a characteristic physical and chemical phenomenon occurring on a surface or an interface. Therefore the fine particle has been attracting attention in various industrial fields. Various microforces, such as forces caused by Van der Waals interactions, electric double layers, thermal motions, and force of gravity, act on the fine particle having a nanometer-order particle diameter. Analyzing these microforces acting on the fine particle is very important to clarify mechanisms of, for example, adsorption and adhesion of the nanoparticle onto a solid surface as well as aggregation and association among a plurality of fine particles. Since the clarification of these mechanisms significantly contributes to the design and the creation of functional materials using nanoparticles, the realization thereof is expected.

As a method for performing three-dimensional measurement of potential of a microforce acting on a single fine particle in a solution, the inventors for the present patent application have proposed an optical-trapping potential measuring method developed by combining laser trapping and nanometer position detection techniques (K. Sasaki et. al., Appl. Phys. Lett., 71, 37 (1997)). The optical-trapping potential measuring method enables a high-speed and high-accuracy three-dimensional analysis of a picoNewton-femtoNewton-order force acting on a single fine particle. Hitherto, while the measurement of a microforce such as a radiation pressure or electrostatic force has been successfully achieved, the measurable sizes of fine particles by the method have still been limited to those of micrometer-submicrometer order. When the particle diameter of a fine particle set as a measurement object is reached to a nanometer order, high-speed fluctuations occur in the position of the fine particle according to a Brownian motion. Therefore a position detecting system in the measurement position cannot follow the speed, thereby disabling the implementation of an accurate measurement. This problem is attributed to the fact that since a continuous-wave laser is used as an observation light source in a measuring apparatus used with the method, the response time in the overall system is limited to a time of microsecond order corresponding to the order of a response time of a position-detecting electronic circuit.

DISCLOSURE OF INVENTION

The invention of the present patent application is made in view of the above situation, and an object thereof is to provide a fine-particle position measuring apparatus capable of performing a real-time measurement of the position of a fine particle having a nanometer-order particle diameter with an accuracy of nanometer order.

In order to solve the problems described above, first, the invention of the present patent application provides an fine-particle position measuring apparatus for measuring of the three-dimensional position of a single fine particle in a solution, including a pulsed laser for measuring the position of the single fine particle, a microscope system for radiating a laser beam emitted from the pulsed laser to the single fine particle, a photodetector for detecting scattering light produced from the single fine particle upon irradiation of the laser beam, a high-speed A/D board for inputting a signal measured by the photodetector to a computer, and the computer for recording the signal measured by the photodetector in the form of displacement data and for performing calculations thereof, wherein data-input timing is set so that the signal measured by the photodetector at the moment of the irradiation of the laser beam is input to the computer.

Second, the invention of the present patent application provides the fine-particle position measuring apparatus, wherein the photodetector is a quadrant photodiode.

Third, the invention of the present patent application provides the fine-particle position measuring apparatus, wherein the single fine particle is set as a measurement object in the solution between two glass substrates opposing each other, and a radiation pressure in an evanescent field generated according to incidence of the laser beam of which the incident angle with respect to one of the glass substrates is set larger than the angle of total internal reflection is caused to act on the single fine particle.

Fourth, the invention of the present patent application further provides the fine-particle position measuring apparatus, comprising a function that calculates a histogram p(r) of the frequency with respect to a positional displacement amount r from a time-series variation R(t) in the displacement amount in the position of the fine particle, which is stored in the computer, and that calculates a potential energy V(r) acting on the fine particle by applying a Boltzmann-distribution equation expressed as $$p(r) = A\exp\left(-\frac{V(r)}{kT}\right)$$

where A: constant k: Boltzmann constant, and

T: absolute temperature (K)

to the histogram p(r) of the frequency.

Figure 1:
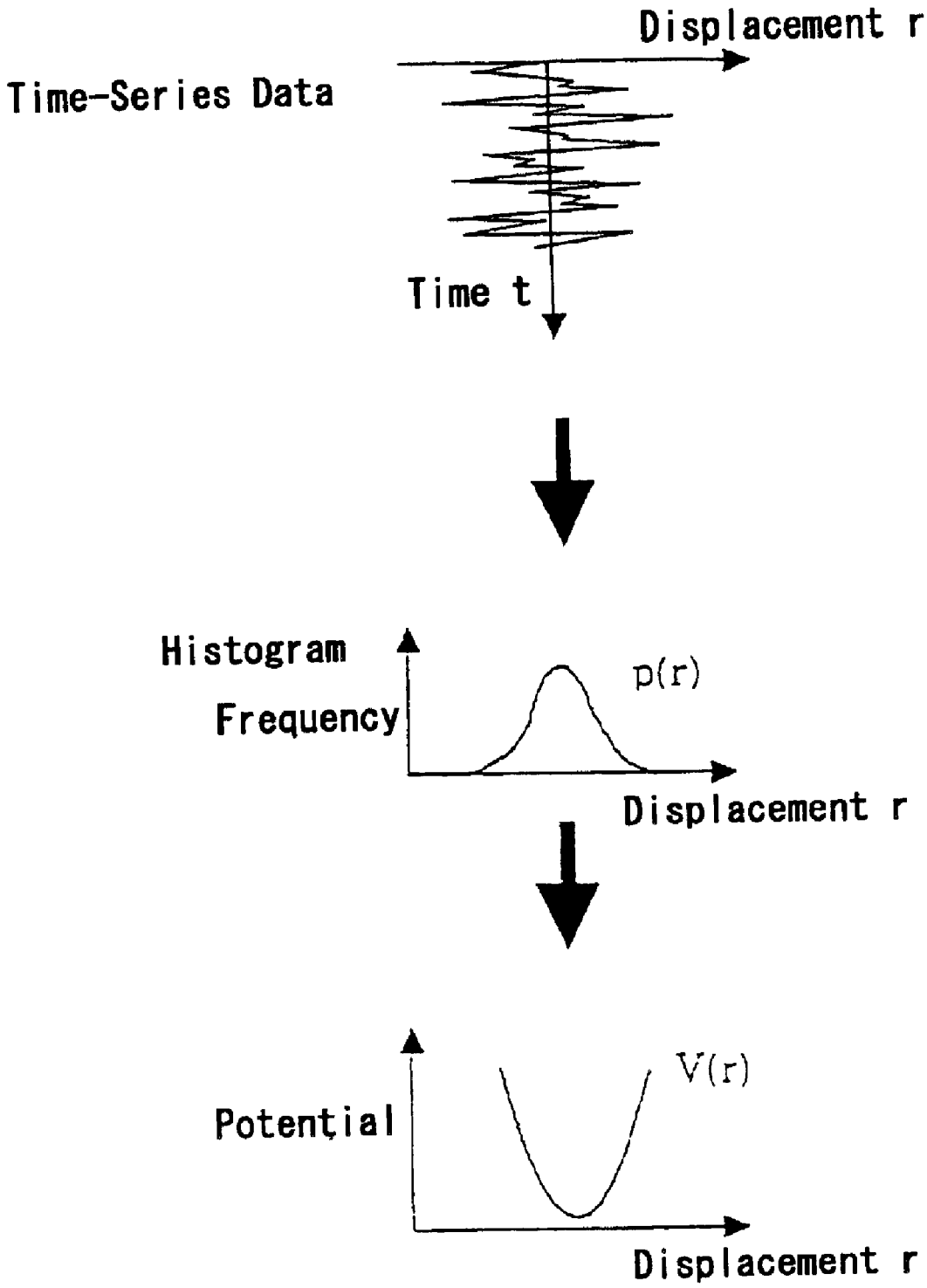
FIG. 1 is a schematic diagram showing a process flow regarding a calculation of a potential energy that acts on a fine particle in a fine-particle position measuring apparatus according to the invention of the present patent application.

The reference numerals in the drawing represent following:

201 laser oscillator
202 dichroic mirror
203 fundamental

204 second harmonic
205 lens
206 glass substrate
207 glass substrate
208 fine particle
209 quadrant photodiode
210 high-speed A/D board
211 computer
212 synchronizing cable

BEST MODE FOR CARRYING OUT THE INVENTION

The invention of the present patent application has features as described above; and hereinbelow, an embodiment thereof will be described.

In the fine-particle position measuring-apparatus according to the invention of the present patent application, a laser beam oscillated by a laser mounted in the fine-particle position measuring apparatus is converged through lenses that constitute a microscope system mounted also in the fine-particle position measuring apparatus. Then, the laser beam is radiated to a solution containing a single fine particle provided as a measurement object.

Upon radiation of the laser beam onto the fine particle, a momentum of the laser beam acts as a mechanical momentum on the fine particle according to a high coherent property of the laser beam. Specifically, the momentum acts on the fine particle as a force field that maintains the position of the fine particle. According to a trapping operation of the laser, positional fluctuation occurring in association of a Brownian motion can be reduced.

In the invention of the present patent application, a pulsed laser beam is used for the laser beam that is radiated to the fine particle. The measurement is performed for the position of the fine particle through detection of a photodetector for scattering light produced from the fine particle momentarily irradiated with the pulsed laser beam. For the photodetector, for example, a quadrant photodiode is used.

A terminal for outputting a laser pulse signal is provided in a laser oscillator, and the pulse signal that has been output from the output terminal is used as a synchronous signal. Thereby, retrieval timing of measurement data can be controlled by using a high-speed A/D board to feed the measurement data into a computer, and detection can be implemented for scattering light produced from the fine particle at the moment of irradiation of the pulsed laser beam.

The position of the single fine particle, which has been measured by the photodetector, is recorded in the computer in the form of displacement data. When calculations are performed for the recorded displacement data, a mechanical potential field acting on the fine particle can also be obtained. Specifically, as shown in FIG. 1, a histogram of the frequency with respect to a displacement amount r is calculated as a function p(r) from a time-series variation R(t) of the displacement amount r of the single fine particle which is stored in the computer; and further, a relational expression shown below on a Boltzmann distribution is applied to the function p(r); thereby, a potential energy V(r) acting on the fine particle is calculated.

$$p(r) = A\exp\left(-\frac{V(r)}{kT}\right)$$

where A: Constant k: Boltzmann constant

T: Absolute temperature (K)

The fine-particle position measuring apparatus of the invention of the present patent application may include means for causing a radiation pressure according to an evanescent field to act on the fine particle in a way that a fine particle set as a measurement object is held in a solution between two glass substrates opposing each other, and a laser beam of which the angle of incidence set greater than the angle of total reflection is incident on one of the glass substrates. The radiation-pressure potential energy in the evanescent field can be calculated by obtaining the difference between mechanical potential energies which act on the fine particle in cases where a radiation pressure according to an evanescent field is caused to act on the fine particle and is caused not to act on the fine particle.

The invention of the present patent application has features as described above; however, it will be described hereinbelow in more detail with reference to an embodiment.

Embodiment

Figure 2:
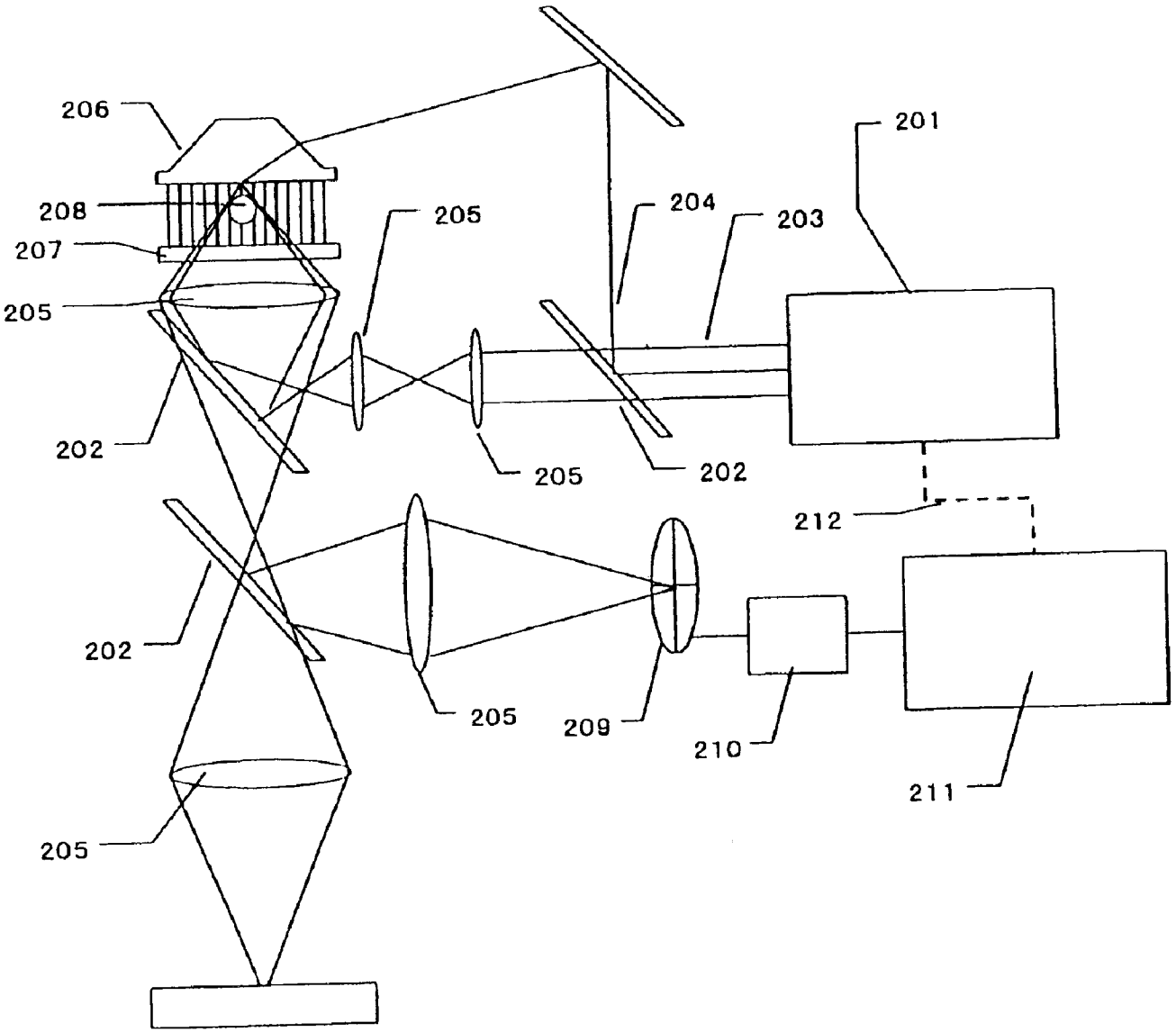
FIG. 2 is an overview showing the configuration of the fine-particle position measuring apparatus according to the invention of the present patent application.

The fine-particle position measuring apparatus of the invention of the present patent application has an exemplified configuration shown in FIG. 2.

A pulsed laser light emitted from a laser oscillator (201) is isolated by a dichroic mirror (202) into a fundamental (203) and a second harmonic (204).

The fundamental (203) converged through lenses (205) is radiated into a liquid disposed between two glass substrates (206) and (207) opposing each other. One fine particle (208) in the solution is trapped in the vicinity of a laser focal point according to a laser trapping operation.

The second harmonic (204) is incident on the upper glass substrate (206), and the fine particle (208) is thereby illuminated. At this time, the angle of incidence of the second harmonic (204) of the laser is set larger than the angle of total reflection, and illumination light radiated from the glass substrate (206) into the solution becomes an evanescent field.

Either the single laser oscillator (201) as shown in FIG. 2 or two laser oscillators having mutually different wavelengths may be used for the illuminating laser and the laser for generating the evanescent field.

A quadrant photodiode (209) is used to detect scattering light produced from the fine particle (208) upon irradiation of the second harmonic (204) of the laser beam. The quadrant photodiode (209) is connected to a high-speed A/D board (210), and a measured electrical signal is input to a computer (211) via the high-speed A/D board (210).

The high-speed A/D board (210) and the laser oscillator (201) are connected together with a synchronizing cable (212), and signal-taking timing is set to agree with the timing of the radiation of the second harmonic (204) of the laser beam.

An practical experiment was performed for an Au fine particle prepared as a measurement object by using the fine particle position measuring apparatus having the configuration described above. An $Nd^{3+}$:YAG laser was used for the laser. A fundamental wavelength $\lambda_{\omega}$ of a pulsed laser beam was 1064 nm, the second harmonic wavelength $\lambda_{2\omega}$ was 532 nm, and the pulsewidth of a laser pulse was 30 ns. Measurements were performed for time-series variations in the positional displacement amount of the single fine particle in individual cases where the evanescent field was caused to act on the fine particle by the fundamental of a laser and it was not caused to act on the fine particle. Data representing the measurement results was input to the computer, the data was converted into the form of a histogram of the frequency with respect to the displacement, and a Boltzmann-distribution equation was applied thereto. In this manner, radiation-pressure potential energies acting in the evanescent field on the fine particle were obtained.

Figure 3:
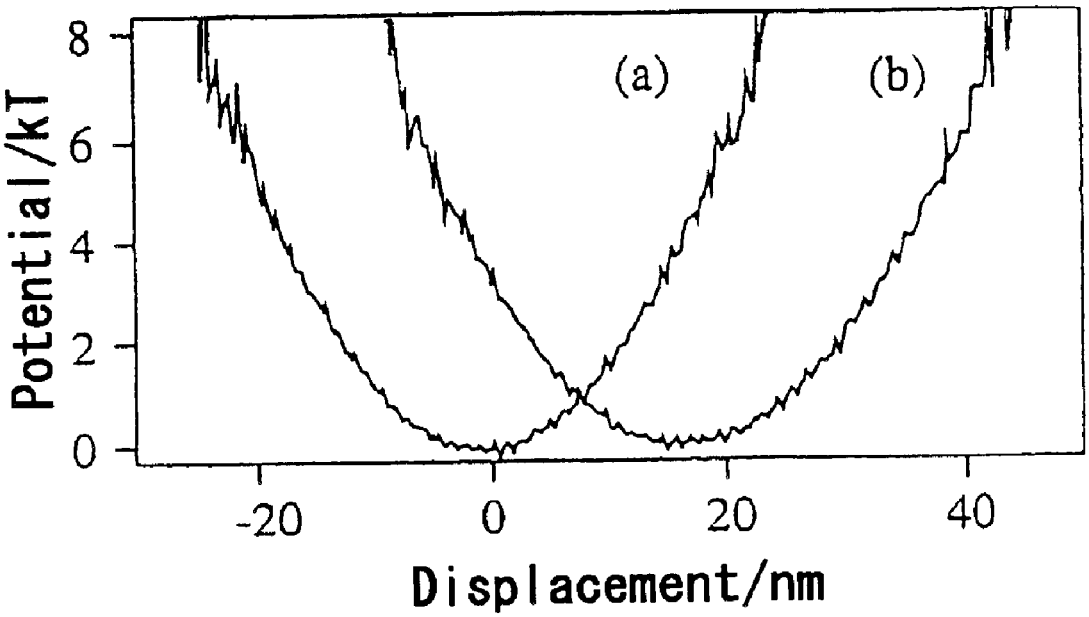
FIG. 3 is a graph showing a potential energy with respect to a positional displacement amount of a fine particle calculated in an embodiment of the invention of the present patent application.
Figure 4:
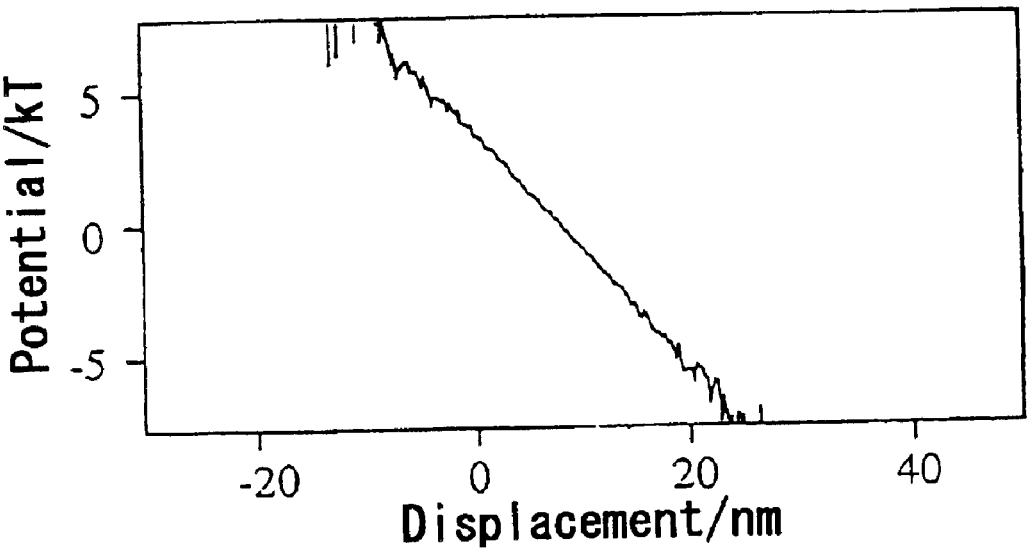
FIG. 4 is a graph showing a radiation-pressure potential energy in an evanescent field that acts on a single fine particle and that was calculated according to the embodiment of the invention of the present patent application.

FIG. 3 shows the potential energies with respect to the positional displacement of the fine particle in the case (a) where the evanescent field was caused to act on the fine particle and the case (b) where it was not caused to act thereon. Use of the difference between the two measurement values enables calculations of the radiation-pressure potential energies acting in the evanescent field on the single fine particle (FIG. 4). The differential value of the waveform shown in FIG. 4 represents the force acting on the fine particle according to the evanescent field. From FIG. 4, it can be known that a force acted on the fine particle uniformly in the direction of the glass plane.

INDUSTRIAL APPLICABILITY

As described above, the invention of the present patent application provides the fine-particle position measuring apparatus capable of implementing real-time measurement for a fine particle having a nanometer-order particle diameter with an accuracy of nanometer order. Furthermore, the invention of the present patent application enables the analysis of, for example, a microforce acting on a fine particle having a nanometer-order particle diameter or a potential energy in the vicinity of a fine particle. Therefore, as means for implementing the clarification of mechanisms of, for example, adsorption, adhesion, aggregation, or association of fine particles, the invention is expected to significantly contribute to the design and the creation of functional materials using micro fine particles.

What is claimed is:

1. An fine-particle position measuring apparatus for measuring of the three-dimensional position of a single fine particle in a solution, comprising a pulsed laser for measuring the position of the single fine particle, a microscope system for radiating a laser beam emitted from the pulsed laser to the single fine particle, a photodetector for detecting scattering light produced from the single fine particle upon irradiation of the laser beam, a high-speed A/D board for inputting a signal measured by the photodetector to a computer, and the computer for recording the signal measured by the photodetector in the form of displacement data and for performing calculations thereof, wherein data-input timing is set so that the signal measured by the photodetector at the moment of the irradiation of the laser beam is input to the computer.

2. The fine-particle position measuring apparatus according to claim 1, wherein the photodetector is a quadrant photodiode.

3. The fine-particle position measuring apparatus according to claim 1, wherein the single fine particle is set as a measurement object in the solution between two glass substrates opposing each other, and a radiation pressure in an evanescent field generated according to incidence of the laser beam of which the incident angle with respect to one of the glass substrates is set larger than the angle of total reflection is caused to act on the single fine particle.

4. The fine-particle position measuring apparatus according to claim 1, comprising a function that calculates a histogram p(r) of the frequency with respect to a positional displacement amount r from a time-series variation R(t) in the displacement amount in the position of the fine particle, which is stored in the computer, and that calculates a potential energy V(r) acting on the fine particle by applying a Boltzmann-distribution equation expressed as $$p(r) = A\exp\left(-\frac{V(r)}{kT}\right)$$

where A: constant
k: Boltzmann constant, and
T: absolute temperature (K)

to the histogram p(r) of the frequency.

* * * * *